United States Patent [19]

Nehrlich et al.

[11] 4,042,207

[45] Aug. 16, 1977

[54] VALVE OPERATING MEANS FOR A MOLTEN METAL CONTAINER

[75] Inventors: Friedrich Nehrlich, Volketswil; Franz Ruckstuhl, Schwerzenbach, both of Switzerland

[73] Assignee: Metacon AG, Zurich, Switzerland

[21] Appl. No.: 652,057

[22] Filed: Jan. 26, 1976

[30] Foreign Application Priority Data

Jan. 28, 1975 Switzerland ..... 1011/75

[51] Int. Cl.[2] ..... F16K 31/122

[52] U.S. Cl. ..... 251/62; 251/291; 222/504; 251/326

[58] Field of Search ..... 251/291, 14, 62, 634, 251/326; 222/504; 164/337

[56] References Cited

U.S. PATENT DOCUMENTS

| | | | |
|---|---|---|---|
| 666,383 | 1/1901 | Hansen | 251/291 |
| 833,143 | 10/1906 | Wolf | 251/291 X |
| 2,921,351 | 1/1960 | Momm | 164/337 X |
| 3,472,269 | 10/1969 | Scholle | 251/291 X |
| 3,613,965 | 10/1971 | Shapland | 222/504 X |

*Primary Examiner*—Arnold Rosenthal
*Attorney, Agent, or Firm*—Cushman, Darby & Cushman

[57] ABSTRACT

A gate-type sliding valve for the outlet of a casting ladle is provided with support arms on which can be pivotably mounted operating means in the form of a hydraulically actuated piston and cylinder and maintained in their operating position by a torque force created by an unbalanced disposition of the weight of the cylinder and piston relative to their pivot mount.

6 Claims, 3 Drawing Figures

12
28 26 23 22
34 35 38 33
11
21
29
40
13
27
24
14
15
42
25 30 36 41 37 23 31 32 16 10 17 19 20 18

28,29 26 24
41 42 33
III
III
40
27
25 34 36 35 37 31

30 34 35 23 33
45 38
26 23 22
I
I
45
34 35 31 38

VALVE OPERATING MEANS FOR A MOLTEN METAL CONTAINER

BACKGROUND AND BRIEF DESCRIPTION OF THE INVENTION

The present invention relates to a gate-type slide valve for use with a molten metal container such as a casting ladle and means for operating the gate valve which can be quickly and accurately mounted at the valve or ladle and removed therefrom.

According to presently employed liquid metal handling arrangements in steel mills for instance, the casting ladle is employed to transfer molten metal from a furnace to a casting or molding station where the molten metal is poured through a gate-type slide valve outlet provided in the bottom of the ladle. In view of the high forces that are required to operate the gate valve, it has become customary to provide servo control devices therefor. Such servo control or operating devices have, in general, employed hydraulically operated cylinder and piston units which are mounted at the ladle or stationary valve element on the one hand and are connected to the slidable valve element on the other hand. Since, however, the casting ladles must be moved about from the furnace to a casting position in a factory, it has been necessary to make the cylinder and piston units removable since it is impractical to provide such units with hydraulic hoses of a length which would afford complete freedom of movement of the casting ladle in the mill. Alternatively, it has been proposed to permanently mount the piston and cylinder arrangement under the casting ladle and to employ quick-connect couplings for the hoses. It is believed, however, that the most widespread practice has been to employ a piston and cylinder unit where the hoses are permanently connected and where the unit can be inserted and detached quickly from the coupling mechanism of the slide valve so as to be removable entirely from the casting ladle.

As is well known, in the casting operation, the casting ladle must often be moved considerable distances between its tapping position at the furnace and the casting positions, and it is only at the casting position that the cylinder and piston unit must be operatively connected to the slide valve of the casting ladle. It is necessary, however, to be able to establish the connection of the cylinder and piston unit with the gate valve in the shortest possible time so as to minimize the danger to which the operators are exposed. It is also, of course, desirable that the disengagement of the piston and cylinder arrangement from the valve be able to be effected rapidly for the same reasons.

Previously employed mounting means for the piston and cylinders have required the insertion of the cylinders from a lateral direction for cooperation or engagement with coupling elements on the slide valve and mounting means on the casting ladle. Such mounting means, however, have required from the personnel high skill and accurate handling of the piston cylinder unit in positioning the latter for engagement with the mounting means of the ladle. In addition, workers have had to stand very close to and beneath the casting ladle itself which in view of obvious dangers is undesirable.

In an attempt to overcome this disadvantage, the use of bayonet-type locking parts have been suggested. These elements, which require rotation of the cylinder-piston unit to effect the interlocking present the danger of inadvertent disengagement if means are not provided to secure these elements in engaged position.

It is an object of the present invention to avoid the foregoing and other disadvantages by providing a coupling means for a gate-type slide valve of a casting ladle which permits a very rapid and accurate insertion and detachment of the piston-cylinder unit and which requires a much less complex mounting for the unit than has previously been the case.

In attaining these objects, according to the present invention, there is provided a pair of mounting arms on the casting ladle having recesses for receiving pivot pins mounted on the cylinder of the valve operating unit in such a position that when the pivot pins are disposed in the recesses, the weight of the piston-cylinder unit will pivot the unit on the pivot pin to bring a connecting element of the piston rod into engagement with an operating arm of the slide valve. Further, this unbalanced mounting of the cylinder unit on the casting ladle will retain the cylinder unit in a stable position while removal of the unit from the mounting arms can still be rapidly effected.

According to the present invention, not only are the coupling units on the slide valve and the piston rod made to engage through the pivoting movement of the piston and cylinder unit, but also, these same elements are kept in engagement as a result of the weight of the cylinder by providing a torque force that constantly acts about the pivot axis.

In an alternative embodiment, the piston rod of the piston-cylinder unit may be mounted so as to be rotatable about its longitudinal axis as well as axially movable in the cylinder and the coupling member of the movable slide valve would be adapted to effect engagement as a result of the axial and rotational movement of the piston rod. Such an arrangement is particularly useful in circumstances where the position of the coupling member of the slide valve cannot previously be accurately or readily determined so as to ensure coupling of the piston rod end upon pivotal movement of the piston-cylinder unit. Thus, the coupling of the piston-cylinder unit to the slide valve can be achieved in two sequential steps, namely, first by pivoting the piston-cylinder unit on the mounting arms of the casting ladle or the slide valve casing and then by a combined axial and radial movement of the piston rod to effect engagement of the coupling member of the piston rod with the coupling member of the slide valve.

Engagement between the coupling member of the piston rod and the coupling member of the slide valve may be aided and maintained by a torque force acting on the piston rod and tending to rotate the latter in a corresponding direction. Such torque force which constantly acts on the piston rod may be provided by excentrically connecting weights therewith, such as the hoses for circulating cooling fluid through axially extending conduits in the piston rod to cool the latter particularly at its coupling end.

The foregoing and other advantages of the present invention will become apparent as consideration is given to the following detailed description and accompanying drawings, in which:

DETAILED DESCRIPTION OF THE INVENTION

Figure 1:
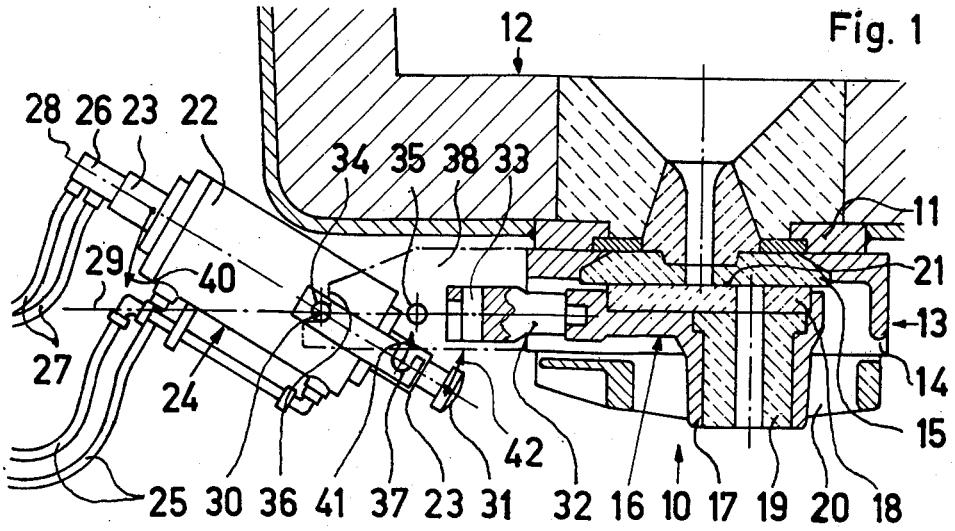
FIG. 1 is an elevational view partly in section of a pivotal mounting arrangement for a piston-cylinder unit where the unit is pivoted out of coupling contact with the coupling arm of a slide valve of a casting ladle.

With reference now to the drawings wherein like numerals designate corresponding parts throughout the several views, there is shown in FIG. 1 a gate-type slide valve generally designated at 13, which is in its closed position and which is attached to the base plate 11 of a casting ladle or other container 12 for liquid metal. The valve 13 includes a main valve housing 14 and a ceramic bottom plate 15, all of which are fixed relative to the outlet passageway of the casting ladle. The valve 13 also includes a movable or slidable valve element 16, which includes a ceramic plate 18, which is carried in a holder 17, provided with the usual ceramic lip 19. A clamping element 20, only part of which is shown, serves to maintain the sealing surfaces 21 of the bottom plate 15 and the aperture slide valve 18 in intimate compression contact and may include guide elements for cooperating with the valve holder 17.

The opening and closing movements of the slide valve member 16 is produced by a piston-cylinder unit 24, which as will presently be described can be quickly mounted to and dismounted from the gate valve 13.

The unit 24 includes a cylinder 22, a double-acting piston (not shown) mounted inside the cylinder 22 in sealing engagement with the interior surface thereof, and a piston rod 23. Piston rod 23 extends through both end walls of the cylinder 22. Hoses 25 supply a fluid medium under pressure to opposite sides of the piston to effect movement of the piston back and forth in the cylinder 22, as is conventional.

Piston rod 23 is hollow over at least a portion of its length and at one end is provided with a nipple 26 for receiving a flow of cooling fluid through hoses 27. To assure adequate flow of the cooling fluid in the piston rod 23, a siphon pipe may be disposed in the hollow bore of the piston rod 23 which extends along the length of the hollow bore. One of the hoses is connected to one end of the siphon pipe, while the other hose is connected to the volume defined by the bore and the exterior surface of the siphon pipe. With this arrangement, the flow of cooling fluid will be in an axial direction in the piston rod 23.

This arrangement is very advantageous in eliminating the extremely large heat loads that are experienced by the piston rod as a result of its contact with the movable slide holder 17, as well as the radiant heat that is always present in molten metal casting operations.

It has previously been the practice to employ double-walled cylinders where the space between the double walls was utilized to convey cooling fluid over the cylinder. However, it has been found that the cooling of the piston rod is much more practical by virtue of the fact that the heat load can be eliminated before it can adversely affect the slide packings on the piston and the rod packings in the opposite end walls of the cylinder 22. Where water is used as a cooling fluid, the cooling efficiency of the system can be easily determined by monitoring the water temperature as it enters and leaves the system, whereas when air is employed, this cannot as a practical matter be done with any accuracy.

In FIG. 1, the unit 24 is shown in its disengaged or uncoupled position. The plane in which the unit 24 pivots is defined by the axes 28 and 29 which, as illustrated, intersect at the pivot axis 30. As used herein, the term operating position will refer to the position of the cylinder-piston unit 24 wherein the coupling elements are in their engaged position. The coupling elements include a collar 31 securely fixed at the front end of the piston rod 23 and a slot 33 formed in an arm 32 which is connected directly to the slide valve element 16. The coupling elements include a pair of pivot pegs 34 for engagement with a pair of slots 36, and stop means in the form of a pair of stop lugs 35 for engagement with locking means formed by a pair of recesses 37.

The collar 31 on the piston rod 23 is shaped to engage the slot 33 of the arm 32 along the valve member 16.

Figure 2:
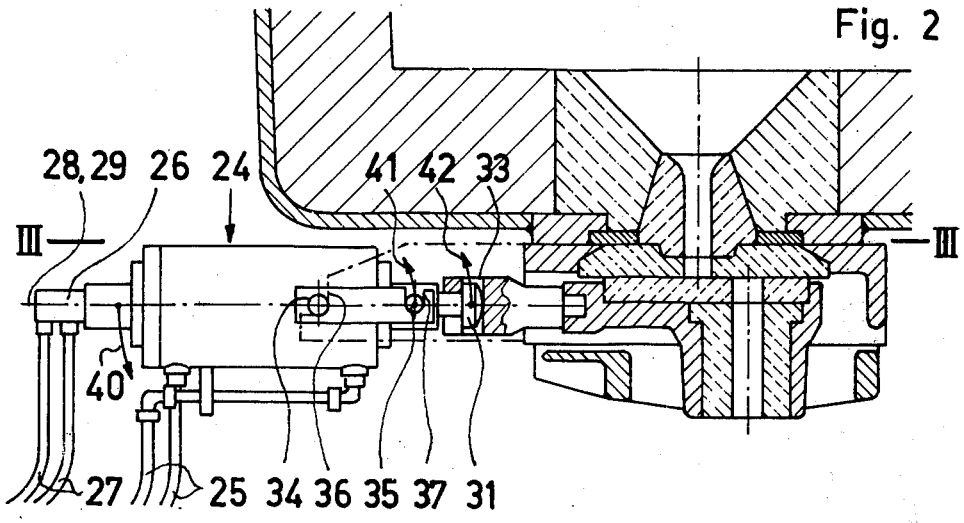
FIG. 2 is a view similar to that of FIG. 1, but with the piston-cylinder unit in its coupled position.
Figure 3:
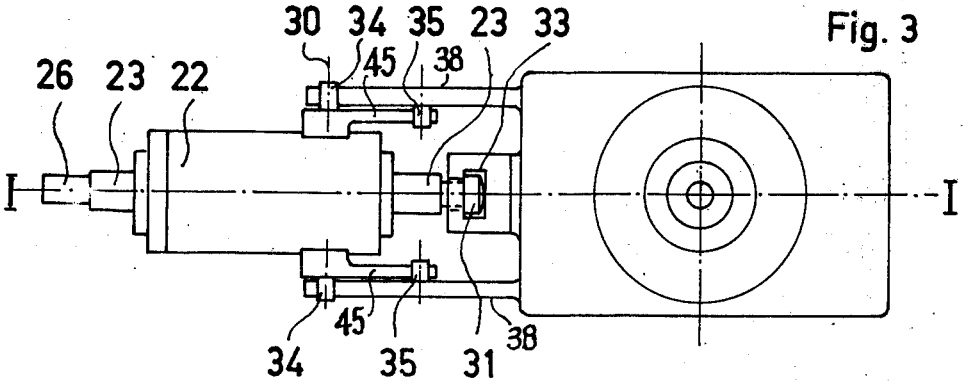
FIG. 3 is a view taken along lines III—III of FIG. 2.

As more clearly shown in FIG. 3, the recesses 37 are provided on arms 45, which like the pivot pins or pegs 34 are located on diametrically opposite sides of the cylinder 22 and which extend parallel to the actuating member or piston rod 23. On the other hand the slots 36 and the stop lugs 35 are provided on arms 38 rigidly connected to opposite sides of the valve 13. Of course, the slots 36 may be formed on the parts of the cylinder 22 in place of the pins 34 which may be located on the arms 38, if desired. It is, of course, important that the pins 34 and the slot 36 be located so as to provide a pivot connection for the cylinder 22 on a fixed valve part 13 so as to accurately locate the pivot axis 30 and that the engagement of the lugs 35 with the recesses 37 in the pivoting end position or operating position of the cylinder 22, shown in FIG. 2 and 3, constitutes a lock by mens of which reaction forces may be transmitted from the cylinder 22 to the valve 13 upon actuation of the valve member by the piston or its actuation member, i.e., the piston rod 23.

With the arrangement as illustrated in FIG. 1, it will be appreciated that the mounting of the cylinder 22 on the arm 38 can be rapidly effected and that the pivoting of the cylinder 22 in a counter-clockwise direction about pivot axis 30 will be affected automatically where the pivot axis is located toward one end, as illustrated, of the cylinder 22 and the center of gravity of the piston-cylinder unit is located to the left of pivot axis 30. Thus, the cylinder 22 can be easily lowered into its operating position as illustrated in FIG. 2 where the coupling elements 34, 36 and 35 and 37, as well as elements 31 and 33 are in their engaged positions. It is not absolutely essential that the center axis of each of the pivot pins 34 be exactly coincident with the point where axes 28 and 29 intersect. Obviously, the axis 28 can be displaced perpendicularly to permit adequate clearance for the pivoting movement of the cylinder 22.

It is, of course, important that in reaching the operating position, the coupling elements of the slide valve 16, namely, the slot 33 and the collar 31 of the piston rod 23 be located so that they will engage upon pivoting of the cylinder 22. As a practical matter, this can be readily achieved by so selecting the arrangement of the elements that in one of the two possible limit positions of the valve, i.e., either fully open or fully closed, the piston rod will be either fully extended or fully retracted so that the collar 31 on the piston rod 23 will be able to engage the slot 33. As can be clearly seen in FIGS. 2 and 3, pivoting movement of the cylinder 22 is halted by the abutment of the lugs 35 with the slots 37 formed at the ends of arms 45.

The piston-cylinder unit 24 conventionally has a weight on the order of 30–80 kilograms depending on the required displacement force and length of the stroke required to open the slide valve. The unit 24 can, therefore, be inserted and detached from the casting ladle manually by operating personnel.

As previously noted, the present invention advantageously employs the weight of the cylinder-piston unit 24, as well as the weights of the hydraulic and coolant hoses 25 and 27 by locating these weights selectively relative to the pivot axis 30 so that a moment of force designated by the arrow 40 will act to pivot the piston-cylinder unit 24 and hold the unit in place in its operating position. It has been found that no other forces or mechanical means will be required to assure the stable and accurate position of the unit 24 in its operating position. Where a bayonet-type of coupling between the end of the piston rod and the arm 32 of the slide valve is employed, a weight may be attached excentrically to the piston rod to form torque load means tending to produce the rotary motion required to effect the bayonet coupling. Alternatively, these torque load means may be constituted by cooling fluid hoses similar to hoses 27, shown in FIGS. 1 and 2. It will be understood that in order to permit coupling of the piston rod with the arm 32 by a rotary motion of the piston rod about its longitudinal axis in a sequential step subsequent to the coupling of the piston-cylinder unit by pivoting movement, the piston rod must be capable of rotary movement relative to at least the cylinder of the piston-cylinder unit.

While the foregoing has been a description of a preferred embodiment of the present invention, it will be understood by those skilled in this art that various modifications may be made therein without departing from the spirit and scope of the present invention as defined in the appended claims.

What is claimed is:

1. The combination comprising gate-type slide valve means for a molten metal container having an outlet opening and means for operating said valve means, said valve means including a valve member slidably mounted to move between an open and closed position transversely with respect to the opening of the container, said valve member having coupling means fixed thereon to be movable therewith, said valve means further including support means for pivotably supporting said valve operating means and stop means defining a pivoting end position for said valve operating means, said valve operating means including an actuating member movable in a forward and a rearward direction and having means for coupling with said coupling means of said valve member to permit transmission of movement to said valve member in both of said directions when said respective coupling means are engaged and said valve operating means are in said pivoting end position, said valve operating means further having a center of gravity disposed to pivot said valve operating means toward said pivoting end position and maintain engagement thereof with said support means and said stop means independent of the position of said actuating member of said valve operating member.

2. The combination comprising gate-type slide valve means for a molten metal container having an outlet opening and means for operating said valve means.

said valve means including a valve member slidably mounted to move between an open and closed position relative to the opening of the container, said valve member having coupling means fixed thereon to be movable therewith, said valve means further including support means for pivotably supporting said valve operating means, said valve operating means including a cylinder having walls at each end thereof, a piston slidably disposed in said cylinder, a piston rod fixed to said piston and extending through at least one end wall of said cylinder exteriorly thereof, said piston rod having a free end outside of said cylinder, said free end having means for coupling with said coupling means of said valve member so that movement of said piston rod will effect movement of said valve member when said respective coupling means are engaged, means for supplying fluid to said cylinder to move said piston therein, said cylinder having a center of gravity and means for rotatably engaging said support means of said valve means located on said cylinder between said center of gravity and said end wall through which said piston rod extends so that cylinder is pivotable about an axis between an uncoupled and a coupling position corresponding to movement of said coupling means on said free end of said piston rod along a predetermined arc, said support means and said cylinder means having stop means for stopping pivoting movement of said cylinder when said cylinder moves to said coupling position whereby, when said coupling means on said valve member intersects said predetermined arc, said coupling means on said free end of said piston rod will engage said coupling means on said valve member and will be disengaged therefrom when said cylinder is pivoted from said coupling postion to said uncoupled position.

3. The combination as claimed in claim 2 wherein said support means on said valve means includes a pair of spaced apart arms extending generally horizontally to one side of said valve means and vertically extending slots formed at the free ends of said arms and said means for rotatably engaging said support means on said cylinder including pins extending laterally from the sides of said cylinder and spaced apart so as to each interfit with one of said slots with said slots and said pins defining a pivot axis.

4. The combination as claimed in claim 2 wherein said coupling means on said valve member comprises a slot and said coupling means on said piston rod comprises a collar of a size such that said collar is insertable into said slot upon pivoting movement of said cylinder from said uncoupled to said coupling position.

5. The combination comprising gate-type slide valve means for a molten metal container having an outlet opening and means for operating said valve means, said valve means including a valve member slidably mounted to move between an open and closed position relative to the opening of the container, said valve member having coupling means fixed thereon to be movable therewith, said valve means further including support means for pivotably supporting said valve operating means and stop means defining a pivoting end position for said valve operating means, said valve operating means including an actuating member having means for coupling with said coupling means of said valve member to effect movement of said valve member when said respective coupling means are engaged and said valve operating means are in said pivoting end position, said valve operating means further having a center of gravity disposed to pivot said operating means toward said pivoting end position and maintain engagement thereof with said support means and said stop means, said valve operating means including a cylinder having two ends and wherein said actuating member is a piston rod rotatably supported in and extending out of said cylinder at both ends thereof, said piston rod having two free ends, one of said free ends carrying the respective one of said coupling means, said coupling means of said valve member and said coupling means of said piston rod being capable of coupling engagement by rotary movement of said piston rod in said cylinder in a predetermined direction when in said pivoting end position and wherein torque load means are connected to said piston rod at the other end of said free ends which tend to rotate said piston rod in said predetermined direction to thereby effect and maintain said coupling engagement.

6. The combination as claim in claim 5 wherein said piston rod includes axially extending conduits for a cooling fluid and wherein said torque load means are cooling fluid hoses.

* * * * *